US007556165B2

(12) United States Patent
McDade

(10) Patent No.: US 7,556,165 B2
(45) Date of Patent: Jul. 7, 2009

(54) COLLAPSIBLE BOX

(75) Inventor: Clinton McDade, Charlotte, NC (US)

(73) Assignee: Schaefer Systems International, Inc., Charlotte, NC (US)

( * ) Notice: Subject to any disclaimer, the term of this patent is extended or adjusted under 35 U.S.C. 154(b) by 574 days.

(21) Appl. No.: 11/277,989

(22) Filed: Mar. 30, 2006

(65) Prior Publication Data

US 2006/0237456 A1 Oct. 26, 2006

Related U.S. Application Data

(60) Provisional application No. 60/674,104, filed on Apr. 22, 2005.

(51) Int. Cl.
*B65D 6/00* (2006.01)
*B65D 8/14* (2006.01)

(52) U.S. Cl. ..... 220/6; 220/4.28; 220/4.34; 220/7

(58) Field of Classification Search ..... 220/4.28, 220/4.34, 6, 7
See application file for complete search history.

(56) References Cited

U.S. PATENT DOCUMENTS 3,796,342 A * 3/1974 Sanders et al. ..... 220/6
4,798,304 A * 1/1989 Rader ..... 220/6
4,913,302 A * 4/1990 Stonier ..... 220/6
6,981,605 B2 * 1/2006 Kasuya et al. ..... 220/6
2005/0016999 A1 * 1/2005 Richardson et al. ..... 220/4.28

* cited by examiner

*Primary Examiner*—Anthony D Stashick
*Assistant Examiner*—Madison L Wright
(74) *Attorney, Agent, or Firm*—Adams Intellectual Property Law, P.A.

(57) ABSTRACT

A collapsible box, including a bottom, top and first and second opposing endwalls, and first and second opposed sidewalls connecting the bottom and top of the box on opposing sides of the box. Each of the sidewalls have a top sidewall panel attached by a top hinge to the top and a bottom sidewall panel attached by a bottom hinge to the bottom. The top and bottom sidewall panels are attached together along adjacent edges by a center hinge, whereby the top and bottom sidewalls are pivotally-moveable relative to each other and the top and bottom between a erect position and a collapsed position. A catch member is carried on each end of at least one of the top and bottom sidewall panels proximate an extended pivot axis of the center hinge. A complementary catch member is carried on opposing side edges of the first and second endwalls for mating with the respective catch members of the first and second sidewalls to latch the box in the erect position.

13 Claims, 7 Drawing Sheets

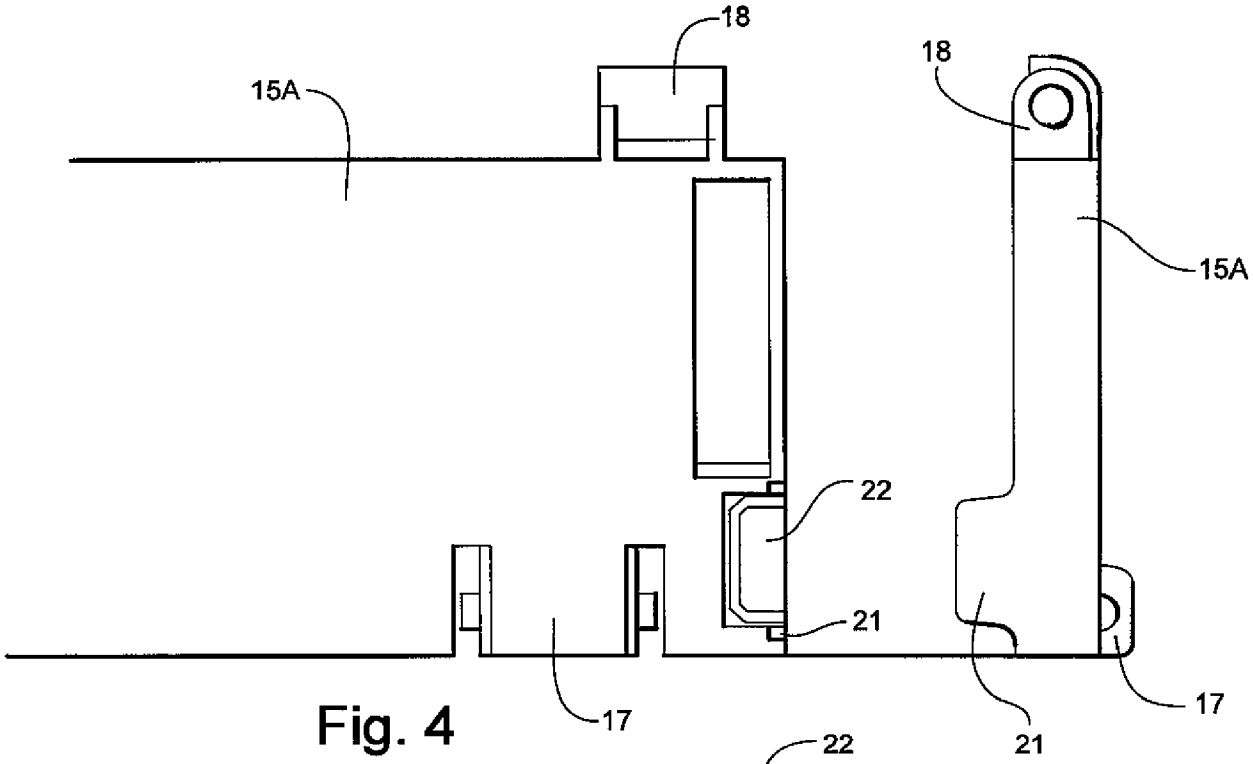
Fig. 5
Fig. 4
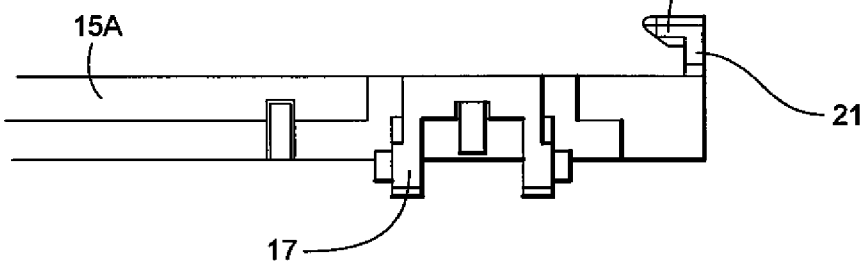
Fig. 6

COLLAPSIBLE BOX

TECHNICAL FIELD AND BACKGROUND OF THE INVENTION

This invention relates to a collapsible box of the general type frequently used to transport items to, for example, assembly lines or to other particular commercial and industrial locations, where the box is emptied. The ability of the box to be collapsed permits a large number of empty boxes to be returned to a remote location for cleaning and/or refilling in a much smaller volume of space than if the boxes remained in the erect condition.

Many prior art collapsible boxes have two pairs of catches on each end of the box—one for each of a top sidewall panel and a bottom sidewall panel. For many applications this is a desirable design, since each wall panel has its own catch and is thus tied directly to the endwall panels.

In other applications, however, the two pairs of catches—one for each of the top and bottom sidewalls—is unsuitable because the bottom catch requires a clearance, for example, a cavity, in the bottom of the box to capture and retain the male catch member on the bottom sidewall. Other prior art designs have only a single latch to catch and retain the endwall. These prior art designs position the latch into the top sidewall panel, leaving the bottom hinged sidewall panels unconnected to the endwalls and susceptible to bowing under stacking pressure.

The present invention provides a collapsible box that requires only a single pair of catches on each end of the box, or a total of four for the entire box. This is accomplished by placing a single catch in line with the center hinge that joins the top and bottom sidewalls. The single catch imparts support to both the top and bottom sidewalls through the element of the box that is most susceptible to damage—an integrally-formed, multiple-component single axis hinge that extends the length of the sidewall. Thus, structural integrity and reliability are maintained with a single hinge and with no interference with the bottom of the box.

SUMMARY OF THE INVENTION

Therefore, it is an object of the invention to provide a collapsible box that has a single catch on each corner of the box for latching the sidewalls to the endwalls.

It is another object of the invention to provide a collapsible box that provides structural integrity to the center hinge of the sidewalls.

It is another object of the invention to provide a collapsible box that provides an effective and reliable manner of erecting a collapsible box without interference with the bottom of the box.

These and other objects of the present invention are achieved in the preferred embodiments disclosed below by providing a collapsible box, comprising a bottom, top and first and second opposing endwalls and first and second opposed sidewalls connecting the bottom and top of the box on opposing sides of the box. Each of the sidewalls comprise a top sidewall panel attached by a top hinge to the top, and a bottom sidewall panel attached by a bottom hinge to the bottom. The top and bottom sidewall panels are attached together along adjacent edges by a center hinge, whereby the top and bottom sidewalls are pivotally-moveable relative to each other and the top and bottom between a erect position and a collapsed position. A catch member is carried on each end of at least one of the top and bottom sidewall panels proximate an extended pivot axis of the center hinge. A complementary catch member is carried on opposing side edges of the first and second endwalls for mating with the respective catch members of the first and second sidewalls to latch the box in the erect position.

According to one preferred embodiment of the invention, the top comprises a rectilinear frame and the bottom comprises a bottom wall.

According to another preferred embodiment of the invention, the top, bottom and center hinges comprise single-axis hinges.

According to yet another preferred embodiment of the invention, the catch members are carried by the sidewalls and each comprise a male catch member having a detent on a free end thereof, and the complementary catch members each comprise an opening positioned on respective first and second endwalls and having a shoulder adapted for receiving the detent and latching the detent to the shoulder to thereby retain the top and bottom side walls in an erect position perpendicular to the endwalls.

According to yet another preferred embodiment of the invention, the catch members are carried by one or the other of the sidewalls or the endwalls, and each comprise a male catch member having a detent on a free end thereof, and the complementary catch members carried on one or the other of the sidewalls and the endwalls and each comprise an opening having a shoulder adapted for receiving the detent and latching the detent to the shoulder to thereby retain the top and bottom side walls in an erect position perpendicular to the endwalls.

According to yet another preferred embodiment of the invention, the endwalls are pivotally-mounted to opposing ends of the top and are adapted to move between a position perpendicular to the top in the erect position and a position parallel to the top in the collapsed position, and the opening comprises a notch.

According to yet another preferred embodiment of the invention, the top, bottom, endwalls and sidewalls are formed of plastic, and the catch members and complementary catch members are integrally formed with one or the other of the endwalls and sidewalls.

According to yet another preferred embodiment of the invention, the box is rectangular and the sidewalls have a length greater than the width of the endwalls.

According to yet another preferred embodiment of the invention, the box has no more than four catches for latching the sidewalls to the endwalls in the erect position.

According to yet another preferred embodiment of the invention, a collapsible box is provided, and comprises a rectangular plastic bottom, rectangular plastic top and first and second opposing plastic endwalls. First and second opposed sidewalls connect the bottom and top of the box on opposing sides of the box. Each of the sidewalls comprise a top sidewall panel attached by a single-axis hinge to the top. A bottom sidewall panel is attached by a bottom single-axis hinge to the bottom. The top and bottom sidewall panels are attached together along adjacent edges by a center single-axis hinge. The top and bottom sidewalls are pivotally-moveable relative to each other and to the top and bottom between a erect position and a collapsed position. A single male catch member is carried on each end of one of the top and bottom sidewall panels proximate an extended pivot axis of the center hinge. A single complementary catch member is carried on opposing side edges of the first and second endwalls for mating with the respective single catch members of the first and second sidewalls to latch the box in the erect position.

According to yet another preferred embodiment of the invention, the catch members are carried by the sidewalls and each comprise a male catch member having a detent on a free end thereof, and the complementary catch members each comprise an opening positioned on respective first and second endwalls and having a shoulder adapted for receiving the detent and latching the detent to the shoulder to thereby retain the top and bottom side walls in an erect position perpendicular to the endwalls.

According to another preferred embodiment of the invention, the endwalls are pivotally-mounted to opposing ends of the top and are adapted to move between a position perpendicular to the top in the erect position and a position parallel to the top in the collapsed condition.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 4 is a fragmentary front elevation of a top sidewall panel, showing the catch;

FIG. 5 is a side elevation of the top sidewall panel;

FIG. 6 is a fragmentary top elevation of the top sidewall panel;

DESCRIPTION OF THE PREFERRED EMBODIMENT AND BEST MODE

Figures 1, 1A:
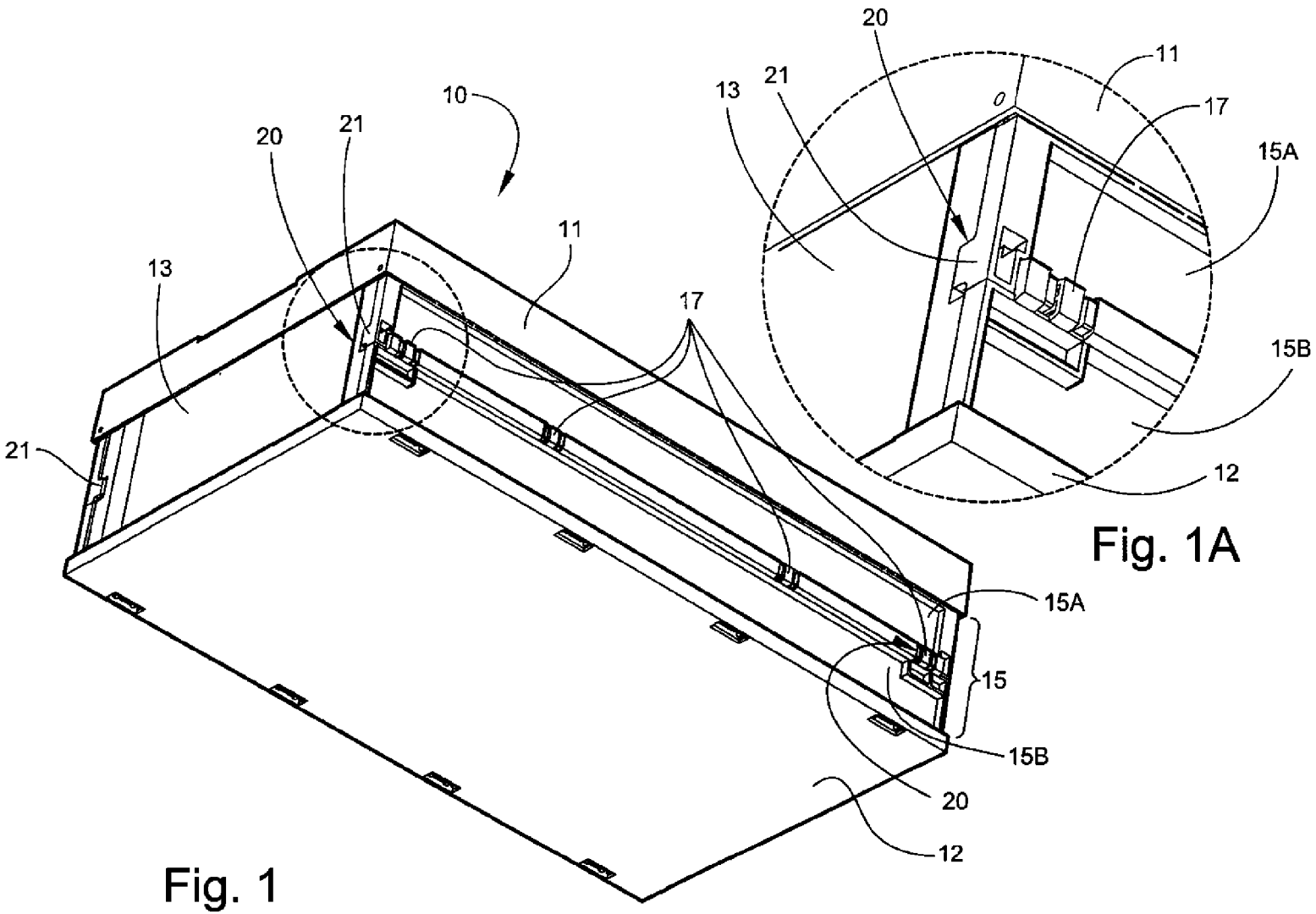
FIG. 1 is a bottom perspective view of a collapsible box according to one preferred embodiment of the invention.
FIG. 1A is an enlarged view of one of the catches of the box shown in FIG. 1.

Referring now specifically to the drawings, a collapsible box according to the present invention is illustrated in FIGS. 1, 1A, 2 and 2A, and shown generally at reference numeral 10. The box 10 as shown illustrates a box of a particular size, shape and relationship between height, width and length. The invention described herein is applicable to a collapsible box without regard to size, shape, intended end use, or material from which it is fabricated.

Box 10 has a top 11, bottom 12, two opposed endwalls 13 and two opposed sidewalls 15. The top 11 may be an open frame defining an opening by which access to the interior of the box 10 is achieved, or may have an attached cover, not shown. The box may be fabricated of a plastic such as polyethylene according to any suitable molding technique. The particular materials and fabrication processes are conventional and not part of the invention. The endwalls 13 are latched in their erect position by features not relevant to this invention.

Figures 2, 2A:
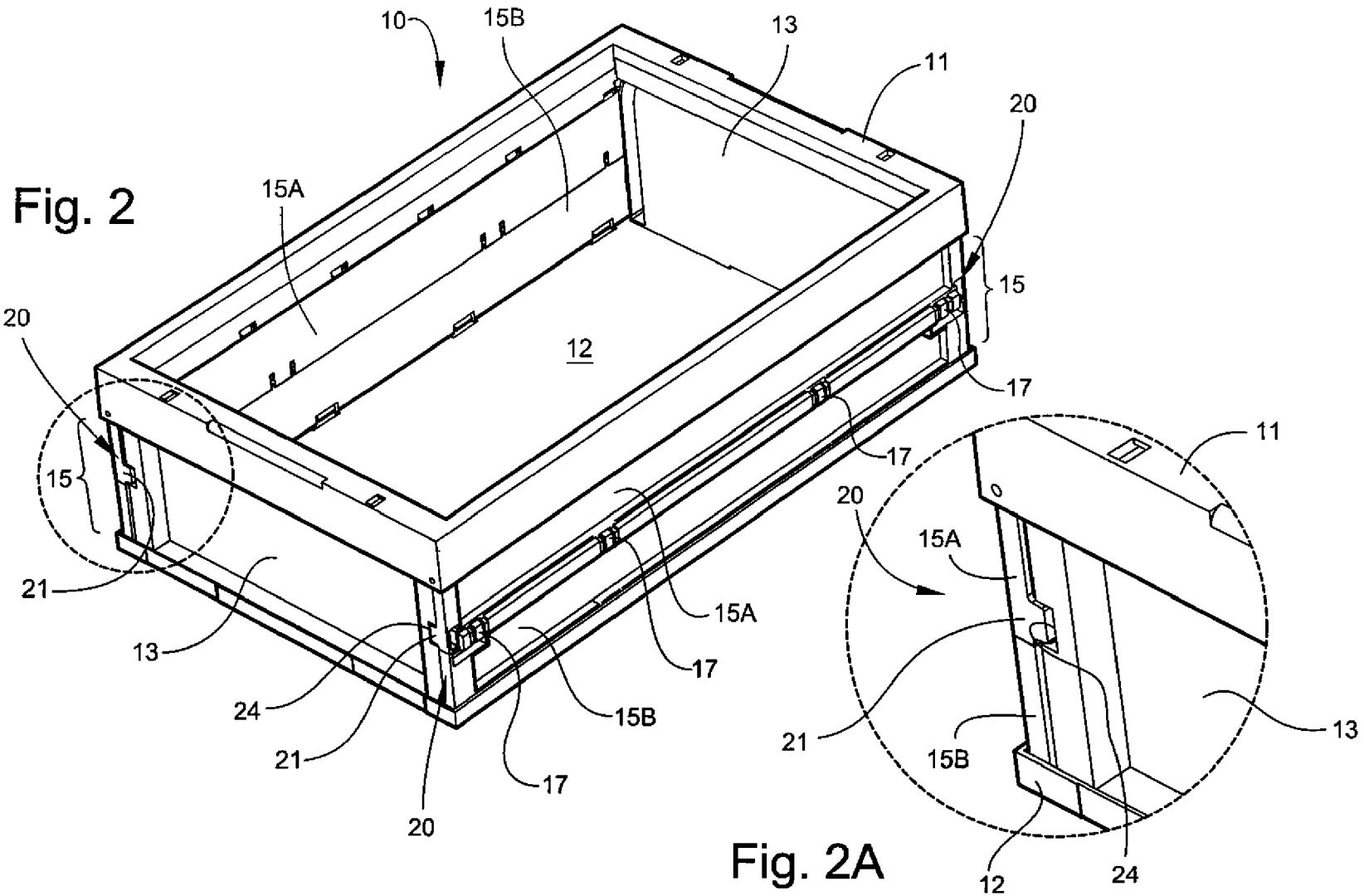
FIG. 2 is a top perspective view of the collapsible box shown in FIG. 1.
FIG. 2A is an enlarged view of one of the catches of the box shown in FIG. 2.
Figure 3:
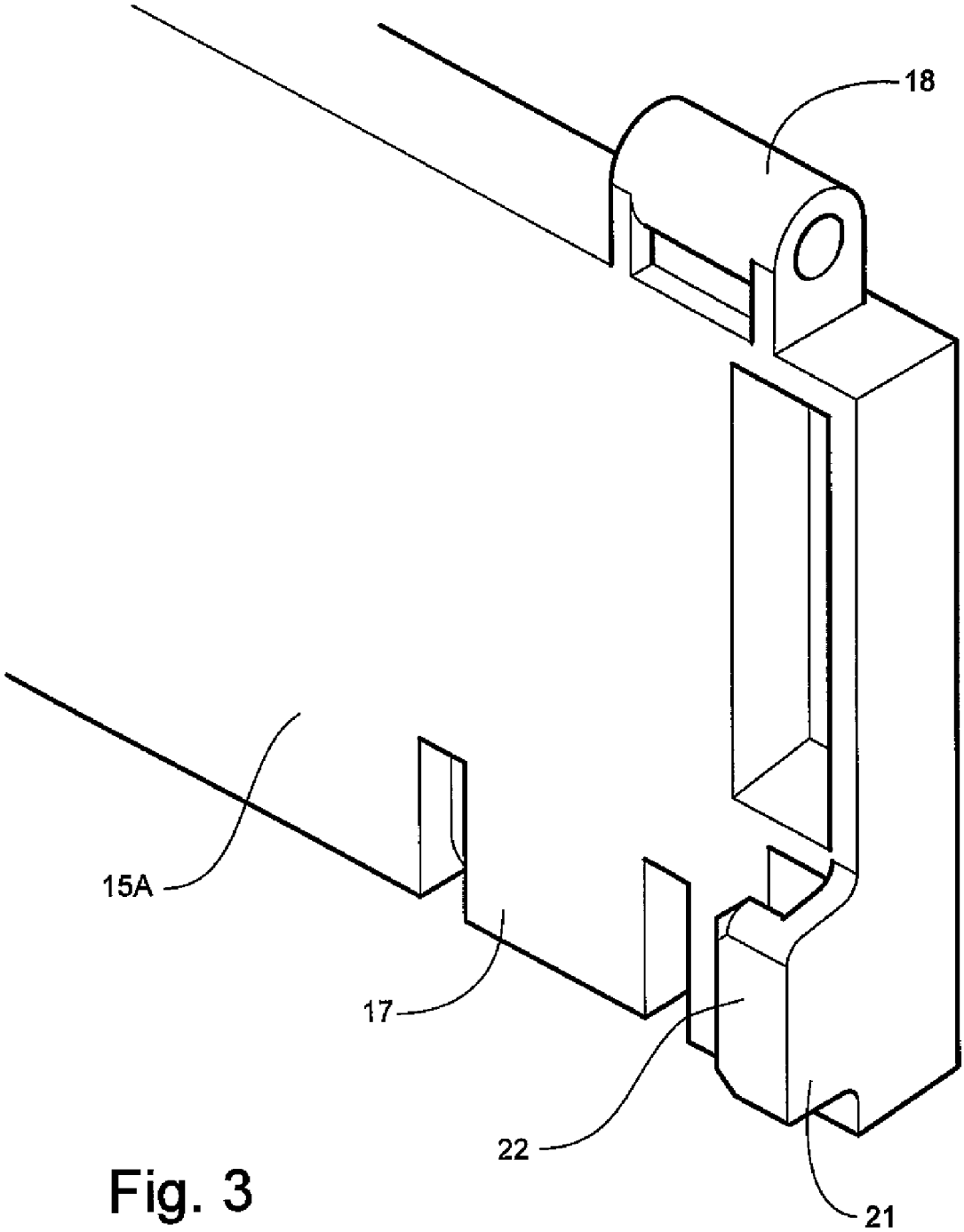
FIG. 3 is an enlarged fragmentary perspective view of an embodiment of a catch according to an embodiment of the invention.

Each of the two sidewalls 15 are formed of a top sidewall panel 15A and a bottom sidewall panel 15B joined along their adjacent side edges by an inwardly-pivoting elongate single-axis center hinge 17. The top sidewall panels 15A are pivotally-attached to opposing sides of the top 11, and the bottom sidewall panels 15B are pivotally-attached to opposing sides of the bottom 12, in the manner shown in FIGS. 1 and 2. As is shown in FIG. 3, the top sidewall panel 15A includes integrally-formed hinge members 18 that cooperate with complementary hinge members, not shown, carried on the opposing sides of top 11. See also FIGS. 10, 11 and 12.

The sidewalls 15 are latched in erect position to the endwalls 13 by means of four catches 20, each of which include a male catch member 21 on the top sidewall panel 15A. The catch member 21 projects inwardly into the area occupied by the endwall 13 when the box 10 is in the erect position. As is best shown in FIG. 6, catch member 21 has a free end 22 that extends at right angles to the catch member 21. See also FIGS. 4 and 5.

Figure 7:
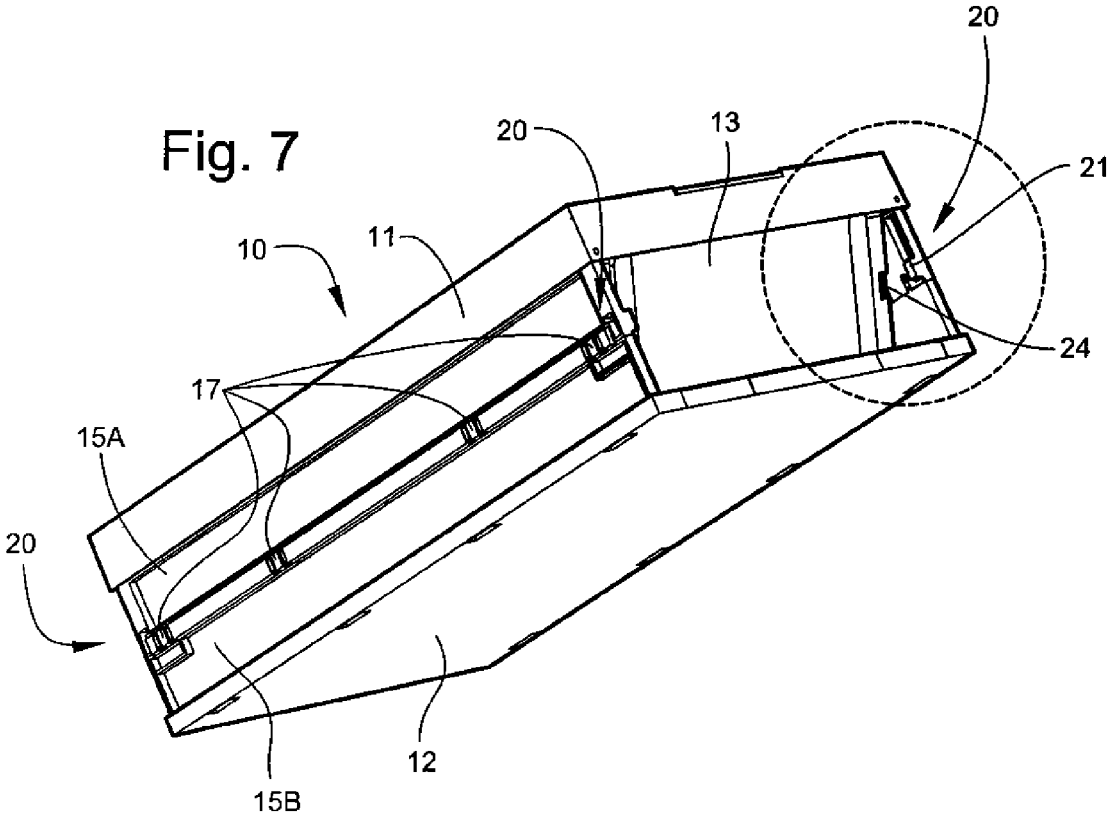
FIG. 7 is a perspective view of an endwall according to an embodiment of the invention.
Figure 8:
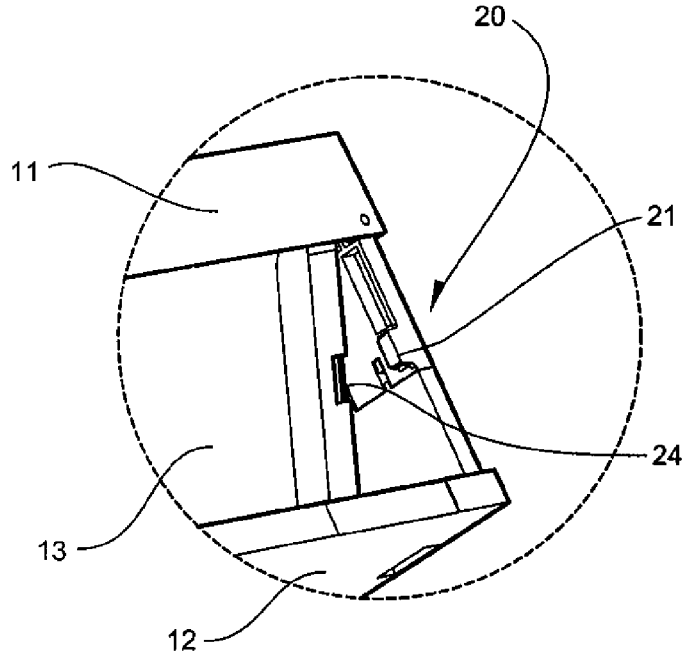
FIG. 8 is a fragmentary view of the collapsible box shown in FIGS. 1 and 2, showing the endwall detached from the sidewall.

As is shown in FIGS. 7 and 8, each catch member 21 cooperates with a complementary catch member 24 formed in the opposing side edges of the endwalls 13. The catch member 24 comprises a vertically-extending slot into which the catch member 21 fits when the endwall 13 is in the erect position. The catch 21 is captured by the side of the endwall and prevents outward bowing of the sidewall 15 during stack loading.

As is apparent from the above description, the catch 20 is located in alignment with the center hinge 17, so that the single catch 20 effectively latches both the top sidewall panel 15A and the bottom sidewall panel 15B while reducing stress on the sidewall pivot elements. The position of the endwalls 13 in the lowered position shown in FIGS. 1 and 2 is the mechanism by which the box 10 is locked in the erect position. The catch 20 does not function to lock the box 10 in the erect position, but rather maintains the sidewalls 15 flush against the side edges of the endwalls 13 and, and noted above, prevents bowing of the sidewalls under load.

Figure 9:
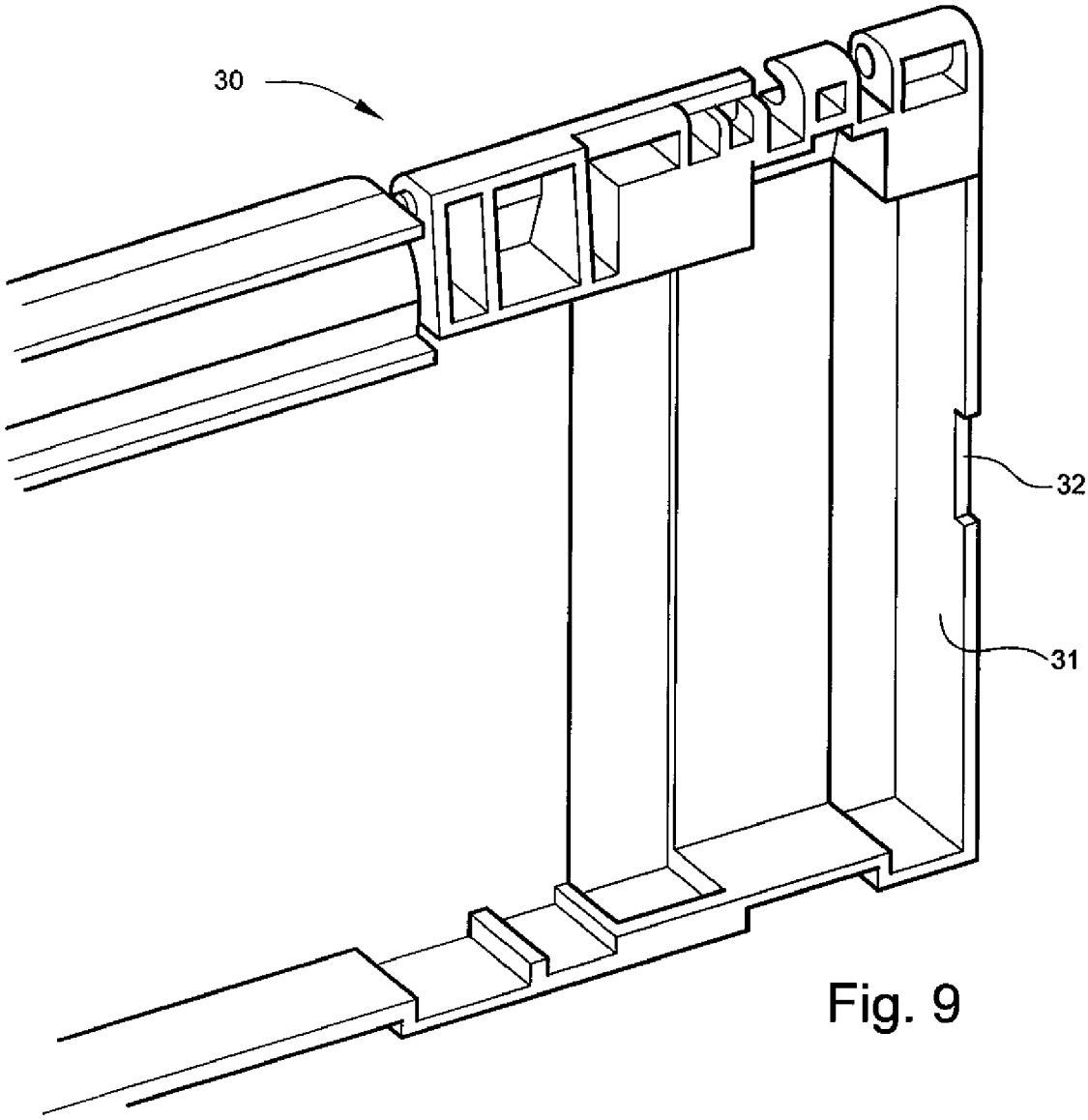
FIG. 9 is an enlarged view of the catch area of an endwall according to an alternate embodiment.

Optionally, the catch member on the endwall can comprise edge ribs past with notches past which the catch member extends in the erect position. This is shown in FIG. 9, where an endwall 30 is provided with two vertically-extending, opposed side ribs 31, each provided with a single notch 32 to capture the male catch member. In another embodiment, not shown, a rib without a notch can be utilized, the entire rib being at a height sufficient to allow the catch member on the sidewall to be captured behind the rib.

Figure 10:
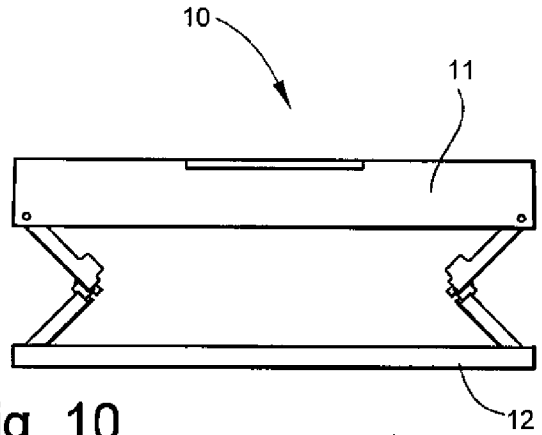
FIG. 10 is a side elevation of a collapsible box in an intermediate position between fully collapsed and fully erect.
Figure 12:
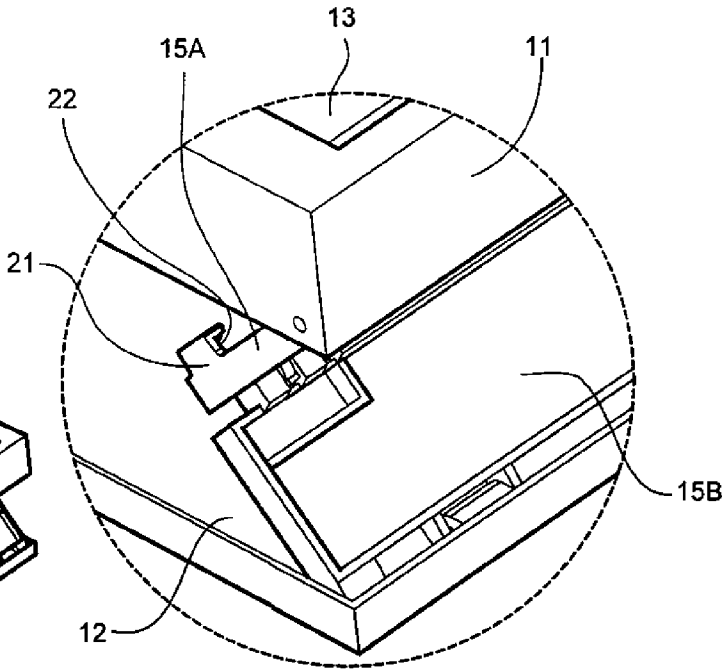
FIG. 12 is an enlarged view of the catch area of the box shown in FIG. 10.
Figure 11:
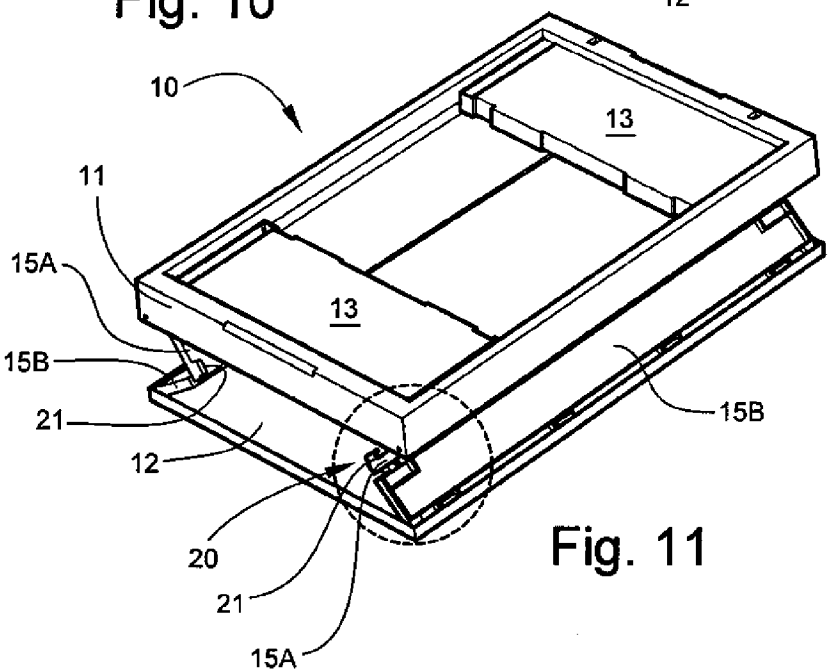
FIG. 11 is a top perspective view of the box shown in FIG. 10.

Referring now to FIGS. 10-12, the box 10 is shown in a position intermediate the erect and collapsed positions. An erect box 10 is collapsed by first disengaging the endwalls 13 and rotating them inwardly and upwardly into a position parallel to and residing in a stored condition within the plane of the top 11. This motion disengages the sidewall panels 15A, 15B from the endwalls 13. The sidewalls 15A, 15B are then collapsed by inward pressure against the center hinges 17 on opposing sides of the box 10. As the hinge 17 collapses inwardly, the top 11 and bottom 12 collapse towards each other.

The combined depth of the top 11 and bottom 12 is sufficient to accommodate both the inwardly-folded endwalls 13 and the inwardly-folded sidewalls 15A, 15B. The sidewalls 15A, 15B collapse into a position where they reside in a flat, folded condition on the bottom 12 with the bottom sidewall 15B resting on the bottom 12, the top sidewall 15A resting on the top of the bottom sidewall 15B and within the lower extent of the top 11. The inwardly-folded endwalls 13 rest on the top of the top sidewall 15A. The resulting position substantially reduces the volume taken up by the box 10, and a large quantity of the collapsed boxes 10 can be stored and transported in a relatively small area compared to the volume occupied by the same quantity of boxes 10 when in their erect condition.

I claim:

1. A collapsible box, comprising:

(a) a bottom, top and first and second opposing endwalls:

(b) first and second opposed sidewalls connecting the bottom and top of the box on opposing sides of the box, each of the sidewalls comprising:

(i) a top sidewall panel attached by a top hinge to the top;

(ii) a bottom sidewall panel attached by a bottom hinge to the bottom;

(iii) the top and bottom sidewall panels attached together along adjacent edges by a center hinge, whereby the top and bottom sidewalls are pivotally-moveable relative to each other and the top and bottom between an erect position and a collapsed position;

(iv) a catch member carried on each end of at least one of the top and bottom sidewall panels in alignment with the center hinge such that the catch member latches both the top and bottom sidewall panels; and (c) a complementary catch member carried on opposing side edges of the first and second endwalls in alignment with the center hinge for mating with the respective catch members of the first and second sidewalls to latch the box in the erect position.

2. A collapsible box according to claim 1, wherein the top comprises a rectilinear frame and the bottom comprises a bottom wall.

3. A collapsible box according to claim 1, wherein the top, bottom and center hinges comprise single-axis hinges.

4. A collapsible box according to claim 1, wherein the catch members are carried by the sidewalls and each comprise a male catch member having a free end thereof, and the complementary catch members each comprise an opening positioned on respective first and second endwalls for receiving the free end of the male catch member to thereby retain the top and bottom side walls in an erect position perpendicular to the endwalls.

5. A collapsible box according to claim 1, wherein the catch members are carried by one or the other of the sidewalls or the endwalls, and each comprise a male catch member having a free end therein, and the complementary catch members carried on one or the other of the sidewalls and the endwalls and each comprise an opening for receiving the male catch member to retain the top and bottom side walls in an erect position perpendicular to the endwalls.

6. A collapsible box according to claim 1, the endwalls are pivotally-mounted to opposing ends of the top and are adapted to move between a position perpendicular to the top in the erect position and a position parallel to the top in the collapsed position.

7. A collapsible box according to claim 4, wherein the opening comprises a notch.

8. A collapsible box according to claim 1, wherein the top, bottom, endwalls and sidewalls are formed of plastic, and further wherein the catch members and complementary catch members are integrally formed with one or the other of the endwalls and sidewalls.

9. A collapsible box according to claim 1, wherein the box is rectangular and the sidewalls have a length greater than the width of the endwalls.

10. A collapsible box according to claim 1, wherein the box has no more than four catches for latching the sidewalls to the endwalls in the erect position.

11. A collapsible box, comprising:

(a) a rectangular plastic bottom, rectangular plastic top and first and second opposing plastic endwalls:

(b) first and second opposed sidewalls connecting the bottom and top of the box on opposing sides of the box, each of the sidewalls comprising:

(i) a top sidewall panel attached by a top single-axis hinge to the top;

(ii) a bottom sidewall panel attached by a bottom single-axis hinge to the bottom;

(iii) the top and bottom sidewall panels attached together along adjacent edges by a center single-axis hinge, whereby the top and bottom sidewalk are pivotally-moveable relative to each other and to the top and bottom between an erect position and a collapsed position;

(iv) a single male catch member carried on each end of one of the top and bottom sidewall panels in alignment with the center hinge such that the catch member latches both the top and bottom sidewall panels; and (c) a single complementary catch member carried on opposing side edges of the first and second endwalls in alignment with the center hinge for mating with the respective single catch members of the first and second sidewalls to latch the box in the erect position.

12. A collapsible box according to claim 11, the endwalls are pivotally-mounted to opposing ends of the top and are adapted to move between a position perpendicular to the top in the erect position and a position parallel to the top in the collapsed position.

13. A collapsible box according to claim 11, wherein the opening comprises a notch.

* * * * *